US008821610B2

(12) United States Patent
Baudis

(10) Patent No.: US 8,821,610 B2
(45) Date of Patent: Sep. 2, 2014

(54) PHLEGMATIZED METAL POWDER OR ALLOY POWDER AND METHOD AND REACTION VESSEL FOR THE PRODUCTION THEREOF

(75) Inventor: Ulrich Gerhard Baudis, Alzenau (DE)

(73) Assignee: Tradium GmbH, Frankfurt am Main (DE)

( * ) Notice: Subject to any disclaimer, the term of this patent is extended or adjusted under 35 U.S.C. 154(b) by 742 days.

(21) Appl. No.: 12/746,985

(22) PCT Filed: Jan. 8, 2009

(86) PCT No.: PCT/EP2009/050163

§ 371 (c)(1),
(2), (4) Date: Jul. 16, 2010

(87) PCT Pub. No.: WO2009/092631

PCT Pub. Date: Jul. 30, 2009

(65) Prior Publication Data

US 2010/0272999 A1 Oct. 28, 2010

(30) Foreign Application Priority Data

Jan. 23, 2008 (DE) ..... 10 2008 005 781

(51) Int. Cl.

| | |
|---|---|
| ***B22F 9/18*** | (2006.01) |
| ***C22C 14/00*** | (2006.01) |
| ***C22C 16/00*** | (2006.01) |

(52) U.S. Cl.
USPC ..... 75/343; 75/350; 75/351; 75/359; 75/369; 420/417; 420/422

(58) Field of Classification Search
USPC ..... 75/343, 351, 359, 369; 148/237
See application file for complete search history.

(56) References Cited

U.S. PATENT DOCUMENTS

| | | | | |
|---|---|---|---|---|
| 1,602,542 | A | 10/1926 | Marden | |
| 3,992,192 | A | 11/1976 | Vartanian | |
| 4,128,421 | A * | 12/1978 | Marsh et al. | 75/255 |
| 4,149,876 | A | 4/1979 | Rerat | |
| 4,470,847 | A | 9/1984 | Hard et al. | |
| 5,073,409 | A | 12/1991 | Anderson et al. | |
| 5,442,978 | A | 8/1995 | Hildreth et al. | |
| 6,902,601 | B2 | 6/2005 | Nie | |
| 6,939,389 | B2 | 9/2005 | Mooney et al. | |
| 7,108,840 | B2 | 9/2006 | Lee et al. | |
| 7,753,989 | B2 * | 7/2010 | Ernst et al. | 75/351 |
| 8,623,112 | B2 | 1/2014 | Loffelholz et al. | |
| 2004/0050208 | A1 | 3/2004 | Nie et al. | |
| 2004/0141870 | A1 * | 7/2004 | Michaluk et al. | 419/13 |
| 2006/0120943 | A1 | 6/2006 | Lee | |
| 2006/0174727 | A1 | 8/2006 | Bick | |

FOREIGN PATENT DOCUMENTS

| | | | |
|---|---|---|---|
| DE | 96317 | B | 2/1898 |
| EP | 583670 | B | 10/1997 |
| JP | 54052608 | B | 4/1979 |
| JP | 562 017791 | U | 2/1987 |
| JP | 05163511 | A | 6/1993 |
| JP | H06 088104 | A | 3/1994 |
| JP | 08269502 | A | 10/1996 |
| JP | 2004052033 | A | 2/2004 |
| JP | 2004247177 | | 9/2004 |

OTHER PUBLICATIONS

Database, WPI week 197923, Thomson Scientific, London, GB 1979 XP002525380.
Fast, J.D. "Ausserordentlich grosse Loeslichkeit von Stickstoff . . ."Naturjundig Laboratorium der N.V. Phillips.
Berger, B. "Methode zur Pruefung der Empfindlichkeit von Explosivestoffen . . ." Techn. of Energetic Mat'ls, p. 55/14; 1987.
Anderson, H. "Factors Controlling the Combustion of Zirconium Powders" Research & Dev. Laboratories; vol. 100, No. 5.

* cited by examiner

*Primary Examiner* — George Wyszomierski
*Assistant Examiner* — Ngoclan T Mai
(74) *Attorney, Agent, or Firm* — Lucas & Mercanti, LLP; Jonathan Myers

(57) ABSTRACT

A method and a device are described for the production of metal powder or alloy powder of a moderate grain sizes less than 10 μm, comprising or containing at least one of the reactive metals zirconium, titanium, or hafnium, by metallothermic reduction of oxides or halogenides of the cited reactive metals with the aid of a reducing metal, wherein said metal powder or alloy powder is phlegmatized by adding a passivating gas or gas mixture during and/or after the reduction of the oxides or halogenides and/or is phlegmatized by adding a passivating solid before the reduction of the oxides or halogenides, wherein both said reduction and also said phlegmatization are performed in a single gas-tight reaction vessel which can be evacuated.

31 Claims, 5 Drawing Sheets

Figure 1:
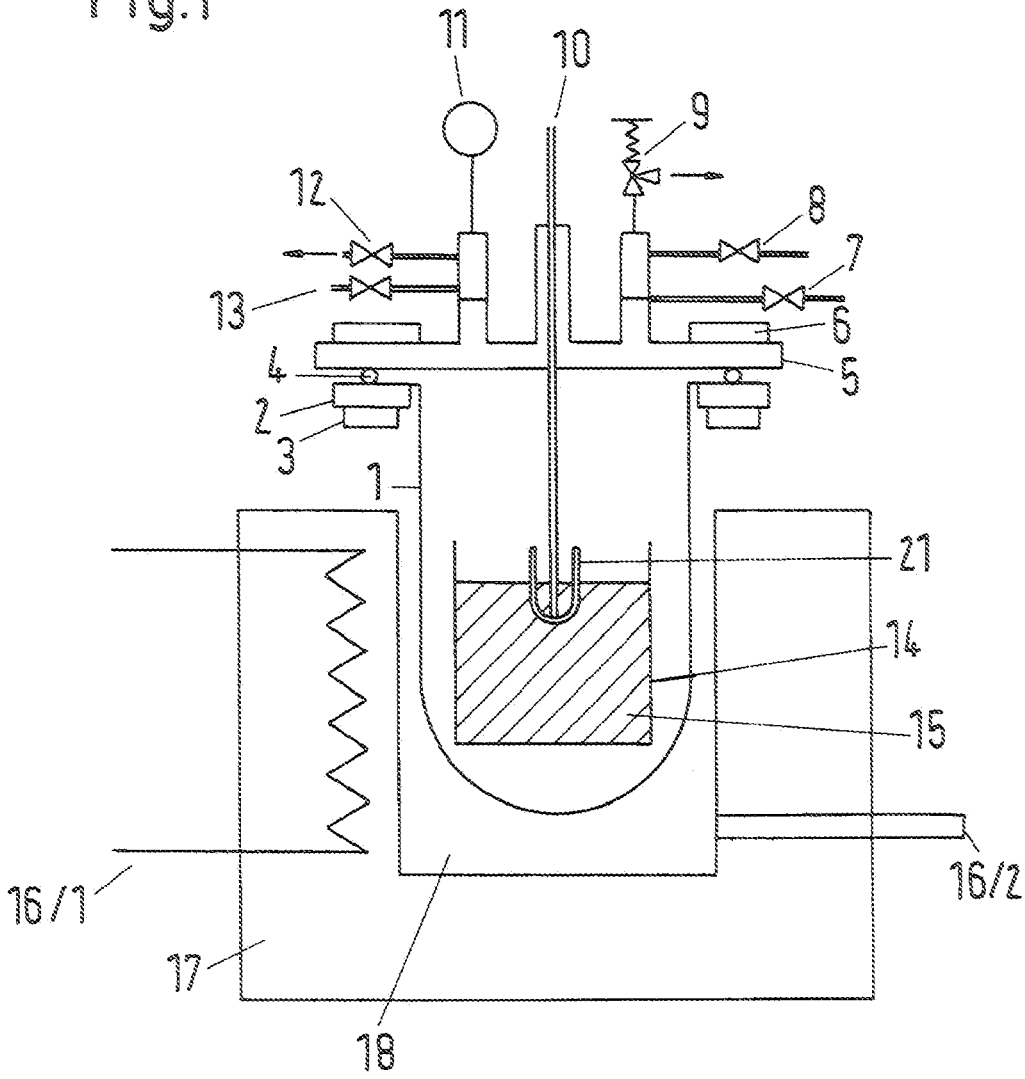

PHLEGMATIZED METAL POWDER OR ALLOY POWDER AND METHOD AND REACTION VESSEL FOR THE PRODUCTION THEREOF

CROSS REFERENCE TO RELATED APPLICATIONS

This application is the US national phase of PCT application PCT/EP2009/050163, filed 8 Jan. 2009, published 30 Jul. 2009 as WO2009/092631, and claiming the priority of German patent application 102008005781.9 itself filed 23 Jan. 2008, whose entire disclosures are herewith incorporated by reference.

The invention concerns making passivated very fine metal powder of the elements zirconium, titanium and/or hafnium that can be handled when exposed to air with an average particle size of less than 10 μm (measured according to permeability methods such as the Blaine or Fisher method) by metallothermic reduction of their oxides using calcium or magnesium, as well as a reaction vessel specifically suited for this work and consisting of a retort crucible, retort cover and inner crucible to make possible the addition of phlegmatizing gases and/or solid substances during and/or after the reduction reaction.

As phlegmatizing additives, hydrogen is especially used in an amount of at least 500 ppm and nitrogen in an amount of at least 1000 ppm; as phlegmatizing solid additives, carbon, silicon, boron, nickel, chromium and aluminum are used in quantities of at least 2000 ppm.

The oxides can be reduced individually to produce pure metal powders. But they can also be reduced mixed with each other or in a mixture with metal powders and/or oxides of the elements nickel, chromium and aluminum to produce alloys of titanium, zirconium and hafnium with these elements.

PRIOR ART

Principles of Metallothermic Reductions

Metallothermic reductions using calcium and magnesium as reducing agent are used for obtaining rare metals from their oxides when they cannot be obtained or can only be obtained at low purity in another way, for example, electrochemically from aqueous solutions, from molten salts or by reduction of their oxides with carbon or with gases such as hydrogen or carbon monoxide. A typical industrial product for this is the production of the rare earth elements such as yttrium, cerium, lanthanum and others as well as the metal beryllium from their oxides or halogenides with magnesium, calcium or aluminum [Römpps Chemical Lexicon: "Metallothermy." Moreover, metallothermic reactions are used to obtain the rare metals in a defined fine powder form, perhaps for applications in powder metallurgy, in pyrotechnics or as a getter in vacuum technology. The particle size of the metal powder that is thus to be produced can largely be predetermined by the selection of the particle size of the corresponding metal oxide that is to be reduced. [Petrikeev, et al, Tsvetnye Met., Number 8 (1991) 71-72].

Further, EP 1 644 544 9 [US 2006/0174727] also describes a method of making metal powders, for example, metal hydride powders of the elements Ti, Zr, Hf, V, Nb, Ta and Cr in which an oxide of these elements is mixed with a reducing agent and this mixture is heated in a furnace, if necessary in a hydrogen atmosphere, until the reduction reaction starts, the reaction product is leached and subsequently washed and dried, so that the oxide used has an average particle size of 0.5 to 20 pm, a specific surface according to BET of 0.5 to 20 $m^2/g$, and a minimum share of 94% by weight. In this process, the design of a suitable reaction vessel is not described.

By mixing various reducible oxides, powder-like alloys can be produced, for example, by mixing zirconium oxide with titanium oxide, an alloy of Zr and Ti, or by mixing zirconium oxide with nickel and nickel oxide an alloy of zirconium and nickel. By mixing the reduction metals and by a suitable selection of particle size of the reducing agents, the start and the kinetics of the reduction process can be influenced. The heat of the reaction depends on the oxides to be reduced, the reduction metal and the possible side reactions. It can be calculated according to thermodynamic principles using the free reaction enthalpy of the educts and the products. In general, the metal calcium followed by aluminum and magnesium has the strongest reduction effect. In the selection of the reducing agent it is to be taken into consideration that it should not form any alloy with the rare earth metals obtained by the reduction, unless this would be specifically desired. Also, the metal oxide of the reduction metal that is formed in the reduction should not form any double oxides or other mixed oxides with the oxide to be reduced, because as a result of this side reaction that occurs in parallel, the yield is reduced.

As metallothermic reductions most often progress quickly and violently at great reaction heat, the vapor pressure of the reduction metal is to be considered relative to the reaction temperature that is to be expected (most of the time 800 to 1400° C.) and, if necessary, to be calculated. Beyond that, the oxide of the reduction metal that is formed in the reduction must be soluble in water or in aqueous acids so that it can be removed from the reaction mass by leaching after the conversion is complete. The poor solubility of the oxides of silicon and aluminum, as well as their tendency to form mixed oxides is the reason that these, per se cost-effective elements are not often used as reducing agent.

In general, metallothermic reduction reactions occur automatically. These are understood to be reactions that are initiated by priming, and thereafter continue automatically without the addition of any external energy. The priming can be initiated chemically, electrically (by a heated wire or by induction) or simply by defined heating of a partial section of the metal/metal oxide-mixture [DE PS 96317]. That is why it is also referred to as hot-spot-ignition.

Gas-fired crucible furnaces or electrically heated furnaces are suitable as reduction furnaces. In other respects, the design of the reduction furnace only plays a subordinate role. Theoretically, the reaction could also be started by a wood fire or coal fire under the retort. A gas-fired crucible furnace has the advantage that the retort is heated quickly. At a temperature of approximately 100 to 450° C., depending on the particle sizes and the type of the substances used, priming occurs that starts at one hot spot located in the lower third of the crucible most of the time containing the mixture that is to be converted. In the reduction of the oxides of Ti, Zr and Hf, the temperature subsequently rises to values of between 900° C. and 1200° C. within a few minutes, depending on whether calcium or magnesium is used as primary reduction metal. Calcium leads to temperatures above 1000° C., magnesium to somewhat lower maximum temperatures. During heating and in particular while the reduction is starting, the pressure in the interior of the retort rises. Upon reaching a superatmospheric pressure of approximately 50 to 100 mbar, a valve is therefore opened and the superatmospheric pressure is vented. Most of the time, it is hydrogen that is formed by the moisture of the substances used, magnesium metal steam, as well as alkali metal steam due to contamination of the substances used.

This way, flames can appear in the release valve. Vapors and dust that are created must be suctioned off at the location of their creation. The opening of the valve can be manual, but also electromechanical or pneumatic, and for safety reasons, it can be controlled remotely, for example, by video observation. As release valves for the superatmospheric pressure, primarily plug valves without gaskets or ball valves with a large cross section are used.

Metallothermic reductions continue to go on autogenously after they have been ignited. The started reaction cannot be stopped by using conventional process technologies such as cooling or by the addition of diluting agents.

This means that metallothermic reduction reactions categorically require special safety measures and well-considered designs of the reaction vessels:

- in order to let the reaction take place controlled during a certain period of time, subject to a controlled atmosphere,
- in order to be able to add defined, small quantities of additional substances to influence the material properties of the rare metals via the gas phase during the reaction,
- in order to control the entire reaction in such a way that it does not develop explosively, and
- in order to produce a product that can be handled when exposed to air, which is not pyrophoric.

An almost always required step in metallothermic reductions for making reactive rare metals is the inertization of the reaction mass prior to, during and after the reduction reaction. For this, the reduction reaction is performed under an inert protective gas, most of the time argon or helium. Alternatively, the reduction can also be started and performed in vacuum.

If one were to perform the metallothermic reduction of zirconium in Example (1), for example, in a ceramic container exposed to air or under a slag blanket similar to EP 0583670[[1 B]], after the reaction, during the cooling of the reaction mass, the formed zirconium powder would again bind with the oxygen in the air. A mixture of badly reduced zirconium metal and primarily zirconium oxide would be found. The small amount of metal obtained would be practically useless. Analogously, this also applies to the metals titanium and hafnium.

In making very reactive rare metals such as zirconium, titanium and hafnium it is necessary to phlegmatize the metal powders in a targeted way in order to subsequently even be able to handle them exposed to air and to be able to process them further. Ultrapure titanium, zirconium and hafnium, completely free of gas and oxygen are pyrophoric in the finest powder form, i.e. they would instantly ignite upon contact with air and burn into their oxides. In the literature, [Anderson, H. and Belz, L., J. Electrochem. Soc. 100 (1953) 240], the limit under which the dangerous pyrophoric zirconium powder is present is seen to be, at an average particle size of 10 μm, as measured according to permeability methods such as those of Blaine or Fisher.

Ultrapure zirconium that is free of gas can even—if it is present in the finest form—react with water under certain circumstances, similar to the known reaction of alkali metals with water, forming hydrogen in an explosive reaction. The literature reports about explosion accidents of this type [Accident & Fire Protection Information, US Atomic Energy Commission Issue No. 44, Jun. 20, 1956].

Metallic titanium, zirconium and hafnium, as well as alloys of these metals are stable in air only because they are is surrounded at room temperature by an oxygen-impermeable oxide cover or oxide nitride cover, the so-called passive layer. Passivation is also known from many other metals such as, for example, aluminum, zinc and chromium. For most metals, passivation occurs by itself. Upon contact of the metal surface with the oxygen and nitrogen of the air, together with moisture and carbon dioxide contained in air, the protective passive film forms without any special effort. This is not the case with respect to the metals Ti, Zr, and Hf, as well as their alloys when they are present in fine powder form and have been produced in a controlled atmosphere under argon, helium or in vacuum. In this case, the targeted addition of phlegmatizing substances, in particular the gases nitrogen and hydrogen, perhaps also oxygen-containing gases, ensures that the metal powder does not spontaneously ignite itself when removed from the controlled gas atmosphere or—as mentioned already—reacts explosively upon contact with water.

The object of the present invention is to provide a method of and a reaction vessel for performing a method of producing metal powders or alloy powders of the reactive metals zirconium, titanium or hafnium from the corresponding oxides or oxide mixtures, whereby the reactive metal powders or alloy powders that are produced are capable of being subsequently handled when exposed to air, for example, for the purpose of further processing.

DESCRIPTION OF THE INVENTION

The above-mentioned problem was solved by a method of making metal powder or alloy powder of an average particle of size less than 10 μm, consisting of or containing at least one of the reactive metals zirconium, titanium or hafnium, by the metallothermic reduction of oxides or halogenides of the cited reactive metals with the help of a reduction metal, whereby the metal powder or alloy powder is phlegmatized

- by adding a passivating gas or a gas mixture during and/or after the reduction of the oxides or halogenides and/or
- by adding a passivating solid substance prior to the reduction of the oxides or halogenides, the reduction as well as the phlegmatization being done in a single reaction vessel that is gas-tight and that can be evacuated.

This method is performed in accordance with the invention in a suitable reaction vessel that will later be explained in further detail.

On the one hand, the method in accordance with the invention, as well as the reaction vessel allow the reduction reaction to be done under inert gases such as argon or helium or in vacuum, in order to preclude uncontrolled access of air and moisture. In particular, the design allows the targeted addition of a measured amount of gases during and/or after the reduction reaction in order to phlegmatize the metals or alloys that are formed in targeted manner and to influence their chemical behavior. The design further allows the reduction of the oxides or oxide mixtures under a reactive gas atmosphere, in particular hydrogen when it is intended to produce the hydrides of the metals Ti, Zr and Hf. It also allows the hydrogenation of alloys produced by molten metallurgy, for example an alloy of 70% Zr and 30% nickel or by sponge titanium by heating and adding hydrogen. In addition to hydrogen, ammonia, methane, carbon monoxide, carbon dioxide and nitrogen can be fed into the retort in order to produce hydrides, sub-hydrides, carbides, nitrides, hydride-nitride mixtures or oxynitrides of the metals zirconium, titanium and hafnium. The construction contains a special design of the cooling of flange and cover in order to prevent the undesired penetration of cooling water into the retort chamber. A special spacer assembly with support ring makes it possible to place the retort at different depths in the combustion space of the reduction furnace.

The reduction metal that is used thereby is preferably calcium and/or magnesium. Thus, calcium and magnesium can be used individually or also jointly. In principle, further additives such as carbon, silicon or silicon oxide and other substances can be added in order to influence the properties of the reactive metal powder that is being produced in the reduction.

Preferably, nitrogen and/or hydrogen is added as passivating gas. Thereby, at least 500 ppm hydrogen and 1000 ppm nitrogen should be contained in the metal powders in order to avoid the above mentioned reactions. For safety reasons, the amount of hydrogen should best be at least 1000 ppm (0.1%), preferably 1000 to 2000 ppm, and nitrogen at least 2000 ppm (0.2%), preferably 2000-3000 ppm. Nitrogen and hydrogen can also be added in the form of ammonia.

As passivating solid substances at least 2000 ppm (0.2% by weight) and at most 30,000 ppm (3% by weight) carbon, silicon, boron, nickel, chromium and/or aluminum can be added. The passivating solid substance can also be reduced together with a metal oxide in the form of a fine oxide of the elements Ni, Cr, Al, Si and B with an average particle size of less than 20 μm. Alternatively, the addition of passivating solid substances in the form of a fine powder of the elements Ni, Cr, Al, Si, B or C with an average particle size of less than 20 μm is possible. According to a further variant of an embodiment of the method, carbon can be added via the gas phase in the form of methane, carbon dioxide or carbon monoxide. Finally, the passivating gases and solid substances can also be added together.

The ignitability of the phlegmatized metal powders or alloy powders can be lowered further by washing out submicroscopic particles that have a particle size of less than 0.2 μm during leaching and/or washing.

The mechanism and/or the reason for this phlegmatization is not known precisely. It can be assumed, but it is not necessarily due to a "layer formation" of metal hydride or metal nitride on the particle surface by these small amounts of gas. In the case of an eventual porosity combined with a high specific surface of the metal powder, there are then certain minimum amounts of N and H required to ensure at least a mono-molecular cover of the metal surface. On the other hand, the metals Ti, Zr and Hf have a considerable solubility for gases. In the zirconium metal matrix, for example, there can be 5% hydrogen and up to 20% nitrogen in solid solution [J. Fitzwilliam et al, J. Chem. Phys. 9 (1941) 678]. For titanium, 7.9% of atmospheric pressure for hydrogen and 18.5% of atmospheric pressure for nitrogen are mentioned [J. D. Fast, (Metal Processing) Metallwirtschaft 17 (1938) 641-644]. A phase formation or compound formation of perhaps $TiH_2$, $ZrH_2$, ZrN on the surface is therefore not certain, because for such, the limits of solubility would have to be exceeded.

One hypothetical concept of the inventor is the following: by placing the gases into the metal matrix, the entire energy level of the free electrons in the metal is lowered so much that the spontaneous reaction with oxygen by combustion or the reaction with water does not happen. In the following wet-chemical processing of the metal powder in water and acid, the actual oxidic passive layer is only formed on the particle surface by a slow oxidation reaction with oxygen from the air and/or by slow reaction with water. As the metal powder is heated only to room temperature or at most to the boiling point of water in the wet-chemical processing, all diffusion processes are slow and indeed, now a dense, firmly adhering "passive layer" of metal oxide (and metal nitride) can form, which permanently protects the metal from further oxidation. This hypothesis is supported by experiments that have been performed by the inventor, which are not described in further detail here, in which during the processing of weakly oxidized substances such as hydrogen peroxide, hypochlorite alkali nitrite or layer-forming substances such as phosphoric acid, phosphates and chromates were added, which increased the passivation of the metal powders. This hypothesis is also supported thereby, that in practice, during the processing of the metal powders in acid and later in wash water, one can always observe a weak gas formation (hydrogen) in the form of the smallest gas bubbles, which is concluded after a period of time of 3 to 12 hours. One also must note that the contents of hydrogen that are analyzed in the metal powders are always higher than the theoretically calculated values based on the addition of hydrogen. Thus, the metals also again absorb hydrogen during the wet chemical processing, the origin of which can be found in the decomposition of excess reducing agent (Mg, Ca) but also in a reaction that takes place at the surface between the metal and water.

In accordance with the invention, particularly the effect of placing gases into the metal matrix is to be utilized. Such a placement is especially advantageously achieved thereby, that the phlegmatizing compounds are added in particular during the reduction reaction already. The degree of passivation is difficult to quantify, it can best be derived from the ignition point of the metal powders exposed to air. For measuring the ignition point of solid substances, various, sometimes also standard methods are available. For the metals Ti, Zr and Hf, the following simple test arrangement is suitable: in a copper cylinder or steel cylinder with a diameter and a height of 70 mm, a hole is drilled in the center with a diameter of 15 mm and a depth of 35 mm. At a spacing of 4 mm, a 5 mm wide hole is drilled that also has a depth of 35 mm, which serves to house a thermocouple element. The block is evenly preheated to approximately 140-150° C., then a quantity of 1-2 g of the metal powder that is to be tested is poured into the larger bore and heating is continued up to ignition, which can be recognized optically (e.g. by a video camera). By analyzing the time/temperature curve of the temperature sensor, the ignition point can be determined fairly accurately. If the ignition points are below 150° C., a safe passivation or phlegmatization cannot be assumed. Metal powders with such low ignition points should be destroyed by combustion at a save site.

Even the burning time provides reference points for the degree of phlegmatization. The method is described in Example 1. References to it can also be learned from measurements of the electric minimum ignition energy which is, however, very difficult to determine. [Berger, B., Gyseler, J., Method of testing the sensitivity of explosives with respect to electrostatic discharge (Methode zur Prüfung der Empfindlichkeit von Explosivstoffen gegen elektrostatische Entladung), Techn. of Energetic Metals, 18th Ann. Conf. of ICT, Karlsruhe 1987, page 55/1 to 55/14].

In the present invention, the phlegmatization of the metal powders of Ti, Zr and Hf, as well as of alloy powders of these metals with Ni, Cr and Al takes place during and/or after the reduction by adding a measured amount of hydrogen and/or nitrogen in the gas-tight retort that can be evacuated. A part of these gases can also be present in the retort from the beginning. Better, and more precisely, the passivating gases can be added to the reaction vessel (the retort) during cooling of the fully reacted mass after reaching the maximum temperature.

The elements Ni, Cr and Al have a dual function, they can be used not only for making alloys of Ti, Zr and Hf, but they also act—in small quantities of between 2000 ppm to 3%—as phlegmatizing fixed additives in the pure metals.

In addition, nonmetallic additives such as carbon, silicon, boron or metallic additives such as iron, nickel, chromium, aluminum and others can influence the reactivity of the zirconium, titanium and hafnium with respect to water, air and oxidation agents. An addition of silicon or boron generally slows down the speed of combustion very little, but it can increase the ignition temperature. A rather negative example is iron. Additives of iron lead to spraying sparks, have a tendency to lower the ignition temperature of the zirconium metal, and most of the time increase the ignitability with respect to friction. Carbon can be added to the retort in accordance with the invention by adding measured amounts of carbon dioxide or methane. In general, it leads to a phlegmatization. Other elements are best added to the starting mixture in the form of their oxides or directly as powder in elemental form. The addition of solid substances in low amounts is, however, connected with the problem that because of insufficient mixing or by segregation, not all metal particles come into contact with the addition, so that in addition to doped phlegmatized metal particles, particles exist that were not alloyed with the addition. The latter can ignite during processing and lead to the combustion of the entire starting mixture. In contrast, gaseous additives distribute themselves evenly in the entire retort chamber and generally reach all metal particles that are formed. For this reason it is recommended to work primarily with gaseous additives.

The phlegmatization in accordance with the invention of the metal powders of titanium, zirconium and hafnium or their alloy powders with gases can be realized on an industrial scale by using a special reaction vessel (a retort). This reaction vessel in accordance with the invention for making phlegmatized metal powder or alloy powder with an average particle size that is less than 10 μm, consisting of or containing at least one of the reactive metals zirconium, titanium or hafnium by the metallothermic reduction of oxides or halogenides of the cited reactive metals with the help of a reduction metal according to the described method is characterized thereby, that the reaction vessel consists of a retort crucible with a coolable cover and an inner crucible that can be inserted into a heatable reduction furnace, the coolable cover having at least one inlet for introducing a passivating gas or a solid substance, and a flange is welded to the retort crucible for putting on a retort cover onto the underside of which a cooler is welded for a coolant. In place of the cited welded connections, other suitable types of connections are also within the meaning of this invention.

The literature describing metallothermic reduction reactions often only mentions that the reaction is performed in a closed retort made of steel under inert gases, without giving any details of the design characteristics of such retorts. Often, firmly bolted-together steel retorts are mentioned, so-called bomb tubes that do not have any openings, at best a connection for a manometer. Although these types of structures allow for the addition of inert gases (Ar, He), reactive gases ($H_2$, CO, $CO_2$, $NH_3$, $CH_4$) or solid additives (Ni, NiO, Cr, $Cr_2O_3$, C, Si, $SiO_2$, B, $B_2O_3$) prior to the reaction to the degree to which the free retort chamber allows, they do not allow it during and after the reduction. Retorts of this type are by all means suitable for the scientific determination of the properties of rare metals, but not in order to produce large quantities of rare metals in a short period of time. With solidly locked reaction vessels, the important properties in pyrotechnics and in getter technology, such as speed of combustion, ignition point and the degree of phlegmatization cannot be adjusted in a targeted manner. Even the opening of locked steel retorts after the reaction has taken place is not without danger, as there is often no information available about the prevailing pressure. Uncooled retorts require a heat-proof metallic or ceramic gasket (copper, silver or heat-proof fibers) between the cover and the retort crucible, which can only be used once in most cases. Also, large retorts can only be sealed with difficulty in this manner; such gaskets only allow the use of small retorts for quantities in the range of kilograms or less. According to an advantageous embodiment of the reaction vessel, the cooler is congruent with a gasket that extends circular under the flange and this cooler has no connection to the actual retort crucible.

For the cooling at the crucible flange and/or for cooling the cover, as an alternative to water, any other coolant can also be used. Thus, for example, organic heat transfer media such as heat transfer oils, preferably silicon oils, or also air can be used. A suitable silicon oil can, for example, be purchased as Therminol® VP from Solutia GmbH. The coolant circulates in a joint or in independent suitable cooling cycles.

The coolable cover has, in addition to the inlet for introducing a passivating gas or solid substance, at least one further connection for a vacuum pump. Further, the cover can have the following connections: a connection with a heat-proof, gasket-less ball valve or plug valve for releasing a superatmospheric pressure, connection for a vacuum pump for emptying the retort, an inlet for introducing inert gases such as argon from a tube, an inlet for introducing reactive gases such as $H_2$ or $N_2$, from a tube, a connection holding the safety valve, a connection to a vacuum or pressure measuring device and a connection for one or more temperature sensors (Pt/RhPt). If appropriate, a groove can also be provided in the cover for a gasket ring, preferably made of Viton, to the extent such is not present at the retort crucible. The water cooling can, for example, be designed as a circular channel on the cover. The cover can, preferably, be connected with the flange by a screw connection.

Further, it is of particular importance that the cooling of the retort cover not be connected to the inlets and the feedthrough fittings of the cover plate. Thereby, in particular, the cooler of the flange should not have a connection to the retort crucible and be open toward the retort wall.

Figure 2:
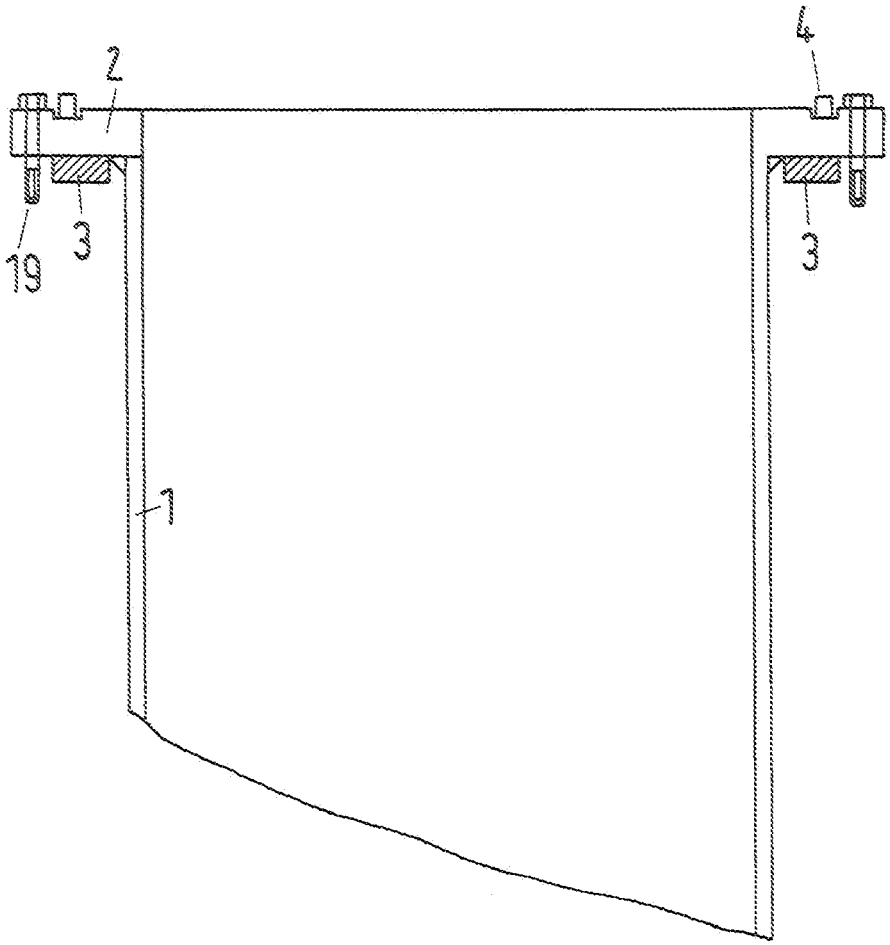
Figure 3:
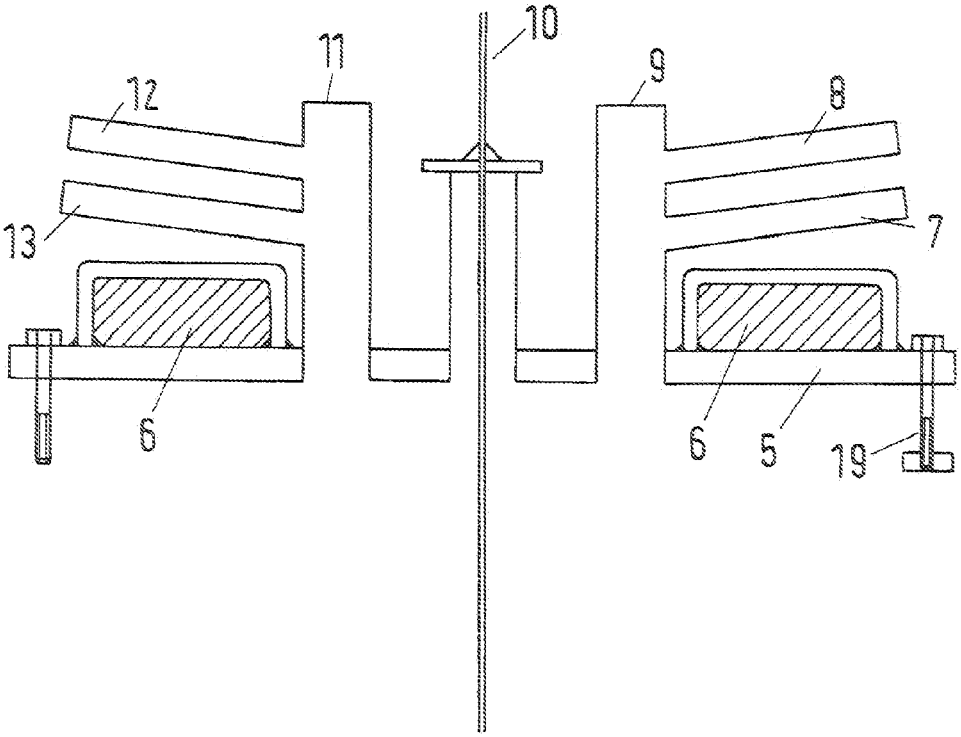
Figure 4:
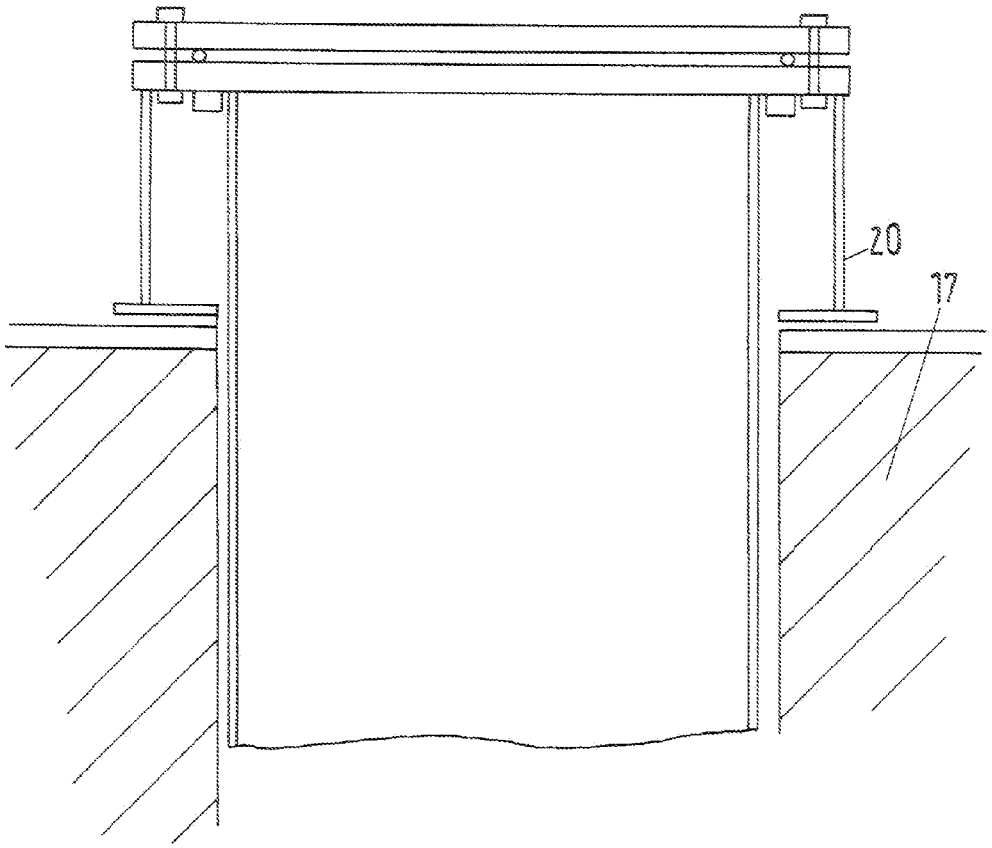
Figure 5:
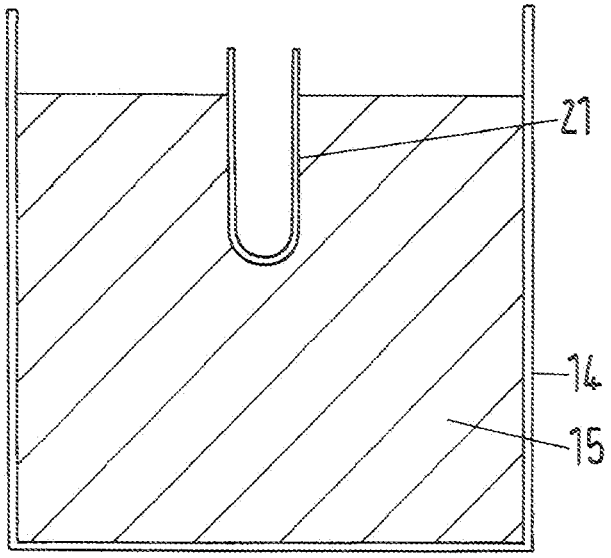

Additional advantages and particularities of the method in accordance with the invention as well as of reaction vessel for performing metallothermic reductions for obtaining the metals zirconium, titanium, hafnium and their alloys, as well as other rare metals in fine powdery, phlegmatized form are seen in the following, nonlimiting embodiment in conjunction with the drawings. Therein:

FIG. 1 shows a reduction furnace with a reaction vessel for performing metallothermic reductions for obtaining the metals zirconium, titanium, hafnium and their alloys, as well as other rare metals, FIG. 2 shows a retort crucible, FIG. 3 shows a cooled retort cover, FIG. 4 shows a spacer assembly, and FIG. 5 shows an inner crucible.

According to FIGS. 1 and 2, the retort crucible 1 is made of a heat-proof steel 1.4841 or a comparable steel that can withstand short-term temperatures up to 1300 to 1400° C. and that preferably has an inside diameter Di=500 mm. The thickness of the wall is at least 10 mm, preferably 15 mm. A flange 2 that has a material thickness of 30 mm and a ring width of 150 mm is welded onto the retort crucible 1 on whose underside a cooler 3 for coolant water is welded. The flange 2 is preferably also made of heat-proof steel 1.4841 or a comparable steel. It is the deciding design characteristic that the cooler 3 is positioned precisely under a circularly extending gasket 4 under the flange 2, and this cooler 3 has no connection to the actual retort crucible 1. The flange 2 allows a cover 5 to be installed, and between the cover 5 and the flange 2 a gasket ring 4 made of Viton, Perbunan, Teflon or a different popular sealing material is used that makes possible a gas-tight and vacuum-tight connection between the cover and the retort crucible. The gasket ring 4 may be set in a groove milled into the flange. Further, a support ring with a spacer bracket 20 is screwed to the crucible flange 2 to make it possible to insert the retort at different depths into the furnace space and/or the combustion chamber 18 of the heatable reduction furnace 17. Heating of the reduction furnace 17 can preferably take place with the help of an electric heater 16.1 or alternatively, with a gas heater 16.2.

According to FIG. 3, the coolable cover assembly has the following design characteristics:

- a cover 5 made of heat-proof steel 1.4841 with a thickness of at least 25 mm, preferably 30 mm, or a comparable material,
- an inlet 12 with a heat-proof and gasket-less ball valve or plug valve for releasing a superatmospheric pressure,
- an inlet 13 for the connection of a vacuum pump for emptying the retort,
- an inlet 7 for introducing inert gases such as argon from a supply,
- an inlet 8 for introducing reactive gases such as $H_2$ or $N_2$ from a supply,
- a connection 9 with a safety valve (p=0.25 bar),
- a connection 11 for connecting to a vacuum or pressure measurement device (a manometer) 0.1-1,500 mbar),
- a connection 10 for insertion of one or several temperature-sensors (Pt/RhPt)
- a water-coolant system 6, and
- an optional groove for holding the gasket ring, preferably made of Viton, to the extent it is not provided on the retort crucible. The water cooler 6 can, for example be designed as an annular channel on the cover 5. The cover 5 can preferably be connected with the flange 2 by a screws 19.

According to FIG. 4, a spacer assembly 20 with support ring is provided between the flange 2 and the heatable reduction furnace 17.

According to FIG. 5, the interior crucible 14 holds the starting mixture 15, i.e. the mixture of metal oxide and the reduction metal that is to be reduced. Depending on the purity requirements, the inner crucible 14 is made of construction steel, heat-proof steel or stainless steel, preferably St37 or VA, with a thickness of 2 to 5 mm, preferably 2 to 4 mm. The inner crucible 14 holds the reaction mass away from the actual retort, which serves only as "receiving vessel" for the duration of the reduction reaction. After cooling, the inner crucible can be removed from the retort and if necessary, stored in a different container under inert gases, for example a stainless steel drum, until the reduced mass it contains will be processed. A protection tube 21 can be inserted into the initial mixture 15 for holding at least one several temperature sensors.

A special inventive characteristic is made of the design of the cooling for the cover 5 and flange 2 of the reduction retort. The cover 5 and retort crucible 1 are connected gas-tight and vacuum-tight by the gasket 4 made of Viton, Perbunan, Teflon or other conventional sealing materials. The gasket 4 can be designed as a flat ring or as O-ring. The gasket 4 must be cooled, as it would otherwise decompose at the high reaction temperatures. In this variant of an embodiment, cooling is done with water. It would be catastrophic if water were to enter into the retort chamber through cracks or through corrosion holes during the reduction reaction. This would lead to a violent hydrogen formation and an explosion in the retort. The design of the cooling is therefore an important characteristic of the reaction vessel. The cooler 3 of the crucible flange is fitted onto the lower face of the flange 2 and has only one connection to the flange itself, but not to the retort wall. Thus, water can never penetrate into the retort from this area. The cooling of the cover 5 is such that it only cools the face of cover 5, however, it has no connection to the inlets and feedthrough fittings. The cooling water would have to penetrate through the massive cover 5 in order to reach into the retort, which is highly unlikely given a wall thickness of at least 30 mm of heat-proof steel. The cooling is shown in more detail as water cooling 6 in FIG. 3.

The retort crucible and the retort cover are connected with a suitable number of screws and nuts 19. The retort, which is made of the retort cover 5 and the retort crucible 1, can immediately be used to house a different inner crucible with a new starting mixture after the inner crucible 14 containing reacted and phlegmatized mass has been removed. Thus, in one furnace, several retorts can be brought to reaction one after the other.

The dimensions indicated in the figures are suitable for a retort for executing the examples, i.e. for obtaining approximately 25 kg of metal powder/starting mixture.

Example 1

An example for a metallothermic reduction using the cited principles and the present invention is obtaining zirconium in powder form by reduction of zirconium oxide with calcium for applications in getter technology (lamps, vacuum parts) and military pyrotechnics, for example, production of thermal batteries.

Zirconium oxide with an average particle size of 5±0.5 μm, as measured according to the Blaine method or the Fisher sub-sieve sizer method, is mixed with calcium chips or granulated metal at a particle size of 0.5 to 5 mm. Calcium metal is added in the theoretically required stoichiometric amount. For controlling the reduction reaction, a small amount, for example, 2 to 10% by weight of the theoretically required stoichiometric amount of magnesium chips with a similar size to those of the calcium is also added. In principle, further additives, perhaps carbon, silicon or silicon oxide and other substances can be added in order to influence the properties of the zirconium powder that is being created during the reduction. The amount of the gaseous additives is measured in such a way that it is later reflected in the isolated zirconium powder in the range of 500 to approximately 5000 ppm, in the case of solid substances of at least 2000 up to 3% as ("contamination"). In the present example, a small amount of silicon oxide is used, which emerges again as Si contamination in the isolated zirconium powder. The mixing of the ingredients takes place under argon in a gyrowheel mixer, a winding mixer or a different comparable mixing organ for solid substances. All ingredients must be kept scrupulously dry. As a result of the addition of small quantities of the second reduction metal (magnesium), the threshold of the initial ignition is lowered, so that the reaction mixture can be brought to ignition easier than when only using calcium. As magnesium evaporates earlier than calcium, as a result of the evaporation of the magnesium, heat is removed from the reaction mass, so that the maximum temperature of the reacting mass is limited.

By adding 3 to 15% by weight calcium oxide (unhydrated lime) or unsintered magnesium oxide one could also, alternatively, dilute the reaction mass, slow down the speed of the reaction and lower the maximum temperature of the reaction. But this procedural method is most often used at the expense of the purity of the zirconium powder that is to be obtained, so that in the present example, working with the addition of magnesium is better.

| Ingredients: | |
|---|---|
| Zirconium oxide (ave. particle size 4.5-5.5 μm) | 36.0 kg |
| Calcium (granulated metal min. 99.7%, 0.5-5 μm) | 26.5 kg |
| Magnesium (chips) | 1.5 kg |
| Silicon oxide | 0.1 kg (=46 g Si → 1840 ppm) |
| Titanium oxide | 0.05 kg (=30 g Ti → 1200 ppm) |

The ingredients are weighed and thoroughly mixed in a drum mixer in an Ar atmosphere, then filled into an inner crucible and stored dry in an argon atmosphere up to use in the reduction retort in accordance with the invention.

For performing the reduction reaction, the inner crucible containing the mixture of the ingredients is inserted into the retort crucible in accordance with the invention, the retort is locked by closing the cover, the entire retort is pumped out twice to an end pressure of less than 1 mbar to remove air and possible moisture, and flooded with argon. At least one temperature sensor is inserted in order through one of the lead-through fittings to measure the temperature in the reaction space. A manometer is connected that shows subatmospheric pressures up to 0.1 mbar, as well as a superatmospheric pressure up to +1000 mbar. Connections are established with gas pressure cylinders containing argon, nitrogen and hydrogen. The gas pressure cylinders are equipped with accurate pressure reducers that are set to a maximum pressure of 100 mbar. The pressure cylinders for nitrogen and hydrogen are filled with pre-measured amounts of these gases. Inert gas argon must always be available at a sufficient surplus. Subsequently, the reduction is started by heating the retort in a gas-fired crucible furnace. Approximately 45 minutes later, the metallothermic reduction reaction starts:

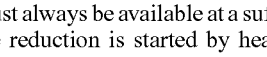

$$ZrO_2+2Ca \rightarrow 2CaO+Zr$$

and parallel

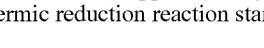

$$ZrO_2+2Mg \rightarrow 2MgO+Zr$$

In the present example, the reaction starts at a temperature of approximately 100-140° C., and within 2 minutes it reaches 1100° C. After exceeding the maximum temperature—recognizable by the decrease of the measured temperature in the reaction chamber by the temperature sensor—the required amounts of gas for the phlegmatization and/or for setting the combustion properties and ignition properties of the zirconium powder are added. In the example, 50 l nitrogen and 130 l hydrogen are added from the connected pressurized gas cylinders in the course of the cooling phase. This corresponds to an amount of 500 ppm hydrogen and 2,500 ppm nitrogen in the created zirconium metal powder. The gases are quickly absorbed by the zirconium metal in the cooling phase. When all gases have been added, the additionally required pressure equalization takes place during the cooling process by the addition of argon. After cooling of the retort to approximately 600° C. in the switched off furnace, the retort is removed from the reduction furnace and hung on a cooling frame where it can cool down to room temperature by adding more argon. The reduction furnace is then freed up and can be used for heating and igniting an additional reaction mixture that has been prepared in the meantime in a second retort in accordance with the invention.

After complete cooling, the inner crucible containing the reaction mass is removed from the retort, the reaction mass is broken out, crushed with a jaw crusher and leached in hydrochloric acid. Thereby, magnesium oxide and calcium oxide are converted into the corresponding chlorides and washed out. A metal sludge of fine zirconium metal powder remains, the particle size of which corresponds approximately to that of the zirconium oxide used, i.e. 5±1 μm as measured according to Blaine or Fisher. The metal powder is washed, filtered wet (<45 μm) and carefully dried (<80° C.). Because of the added additives (here $SiO_2$) and the gases, here $N_2$ and hydrogen, the metal powder can be processed in water and in acid without any danger, without the occurrence of a reaction with water, and later, it can be handled exposed to air without any spontaneous ignition. The yield is 25-26 kg of a fine gray zirconium metal powder.

The burning rate of the metal powder obtained in this way is measured as follows: Into a steel block that is 60 cm long, 1 cm high and 4 cm wide, a continuous, rectangular groove is milled, that is 2 mm deep and 3 mm wide. The groove is filled with 15 g of the metal powder that is to be tested, the powder filling is ignited at one end and the time is measured, which is required by the burning front to travel a marked stretch of a distance of 500 mm. In the present case, the burning rate is 80±10 s/50 cm. The ignition temperature is at 240±20° C. The electric energy for ignition is approximately 18 μJ. A total of 2000 ppm hydrogen is found in the final product due to additional hydrogen absorption during the aqueous processing. The metal powders also contain the contaminations of the reduction metals; however, these amounts are in general small. The amounts of 1800 ppm silicon, 2500 ppm nitrogen and 1000 ppm titanium found correspond well to the theoretical amounts.

Example 2

In a modification of the procedure of Example (1), the retort containing the reacted mass is left in the reduction furnace after the reduction reaction has taken place. By additional external heating, the particle size of the rare metal and/or its burning properties and chemical properties are influenced. With several hours of heating at approximately 900° C., a sintering effect can be achieved that leads to a coarsening of the particle size of the zirconium metal obtained. In the present example, 3-4 hours of heating increases the average particle size of the zirconium metal from approximately 5 μm to 6-7 μm, and the burning rate can be slowed down from approximately 75 s/50 cm to 100 to 120 s/50 cm.

In this procedure, the ignition point of the metal remains nearly unchanged and is at 250° C.±20° C.

Example 3

For making zirconium metal suitable for use in ignition systems of air-bag initiators and militarily used priming charges, the process described in Example (1) is used; however, the following charge materials are used:

| | |
|---|---|
| Zirconium oxide (ave. particle size 1.5/−0.25/+0.5 μm) | 36.0 kg |
| Magnesium (chips, min. 99.8%, bulk density 0.45 g/cm$^3$) | 17.1 kg |
| Silicon oxide | 0.35 kg |

The charge materials are mixed as in Example (1), the inner crucible is filled and inserted into the retort. Unlike in Example (1), the retort is pumped out twice and subsequently filled with 100 l hydrogen, 50 l nitrogen and the rest argon. After heating, the reduction reaction starts upon reaching a temperature of 150° C.±20° C. and reaches a maximum value of 960 to 1050° C. according to the equation

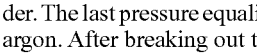

$$ZrO_2+2Mg \rightarrow 2MgO+Zr$$

In the cooling phase, once again 150 l hydrogen and 50 l nitrogen are added to phlegmatize the zirconium metal powder. The last pressure equalization during cooling is done with argon. After breaking out the cooled reaction mass and after leaching with hydrochloric acid, washing, wet filtering under 45 μm and drying, a very fine, very ignitable metal powder is obtained that does, however, not automatically ignite when exposed to air because of the phlegmatization. During washing, decanting is performed several times in order to remove the finest suspended metal particles with a particle size of below 0.2 μm. The yield is approximately 25 kg. The metal powder can be dried carefully at temperatures below 70° C.

The burning rate in a groove (compare Example (1) exposed to air is 10+/−3 s/50 cm. The average particle size of the metal powder is 1.7+/−0.3 μm. The ignition point is at 180+/−10° C. The minimum electric ignition energy was measured at approximately 2 μJ.

The content of silicon approximately corresponds to that which was used and is 5900 ppm (theoretically 6530 ppm). The hydrogen content of the end product is 1400 ppm (theoretically 900 ppm), subject to additional water absorption during acid leaching. The nitrogen content in the end product is at 4000 ppm (theoretically 5000 ppm).

The high ignitability of the metal powder results from the high degree of fineness and the large sensitivity with respect to electrostatic charge. In general, these metal powders are not dried, but stored and transported in suspension under water of at least 30% by weight.

Example 4

Production of a Zr/Ni Alloy

The procedural method of Example (1) is used, however without the addition of $SiO_2$ and $TiO_2$.

| | |
|---|---|
| Zirconium oxide (average particle size 4.5 μm) | 36.0 kg |
| Calcium - granulated metal | 26.5 kg |
| Magnesium (chips) | 1.5 kg |

The reaction takes place as in Example (1), however, after being pumped out the retort is not filled with argon, but with 100 l nitrogen (99.995). By heating, the reaction is started. In this case, it starts at 80 to 100° C. already and reaches a maximum value of approximately 1050° C.

During cooling, for the phlegmatization of the zirconium metal, an additional amount of 100 l nitrogen is added into the retort, the additional pressure equalization being done with argon.

After complete cooling, the reaction mass is broken out, crushed, but not leached, instead it is ground fine in an anhydrous argon atmosphere to a particle size of 150 μm. To this mass of Zr metal, calcium oxide and magnesium oxide, as well as excess magnesium and calcium, 12 kg nickel powder (average particle size according to Fischer 5 μm) is added (Caution, Ni powders are carcinogenic) and are mixed in an argon atmosphere in a drum mixer. Subsequently, the mass is filled into the inner crucible, inserted into the retort in accordance with the invention, evacuated and slowly heated in an argon atmosphere, whereby the furnace temperature is limited to 860° C. The furnace temperature is reached after approximately 1 hour, the interior temperature as measured in the reaction mixture only begins to rise after approximately 3 to 5 hours. Then, within 15 minutes, it rises from approximately 400° to 880-900° C. The heat is switched off as soon as the reaction starts. In the reaction, the nickel oxide that is always contained in the nickel powder is reduced to Ni by the excess reducing agent that is still contained in the Zr reduction mass, and simultaneously, the Zr powder bonds with the nickel to a Zr—Ni alloy with a composition of 70% by weight Zr and 30% by weight nickel. In the cooling phase, 200 l hydrogen is added.

The reaction mass is left standing overnight in the retort in a cooling frame by adding argon. After opening, the mass is broken out, crushed and leached in acid in order to wash out calcium oxide and magnesium oxide. In this case, the leaching must be performed in strongly acetate-buffered hydrochloric acid, as the ZrNi alloy would be corroded by pure hydrochloric acid. The Zr/Ni alloy that remains in suspension is filtered wet (<45 μm) and dried.

The Zr—Ni alloy powder obtained has a particle size of 4-6 μm, measured according to Blaine or Fisher. The yield is approximately 36 kg. The burning time is at 200±30 s/50 cm, as measured in the burning groove described in Example (1). The ignition point is at 260-280° C., the hydrogen content is 0.2% (2000 ppm) with respect to a theoretical value of 500 ppm. It is also shown here that hydrogen forms during the chemical processing in acid and is absorbed by the metal. The nitrogen content was not determined, theoretically, it is about 1% (10,000 ppm). The minimum electric ignition energy was found to be at approximately 100 μJ.

The alloy powder is suitable for making delayed priming charges according to US specification MIL-Z-114108.

OTHER INFORMATION

The zirconium metal powders produced in the examples described are phlegmatized in accordance with the invention and do not spontaneously self-ignite, i.e. they can be exposed to air. By washing out submicroscopic particles below a particle size of 0.2 μm, perhaps by decanting during leaching and washing, the ignitability can be reduced further. Even aqueous processing itself contributes to the passivation of the metal surface. But the latter also causes the Zr, Ti and Hf metal powder to be surrounded with a thin oxide film so it can be electrostatically charged. Then, a spontaneous ignition can occur that is not based on the "classic" self-ignitability, but is based on an electrostatic discharge. Zr, Ti and Hafnium metal powders must therefore always be handled in grounded, as much as possible metallic containers and to the extent possible, be processed under argon. When replicating the examples cited in the invention, corresponding safety measures are to be implemented and professional advice from trained safety specialists should be obtained.

| Reference numbers | |
|---|---|
| 1 | Retort crucible |
| 2 | Flange |
| 3 | Cooling at the crucible flange |
| 4 | Gasket (O-Ring or flat band) |
| 5 | Cover |
| 6 | Water cooling |
| 7 | Inlet for inert gas (argon connection) |
| 8 | Inlet for $H_2$, $N_2$ and other reactive gases |
| 9 | Connection holding a safety valve |
| 10 | Connection by one or more temperature sensors |

-continued

| Reference numbers | |
|---|---|
| 11 | Connection for a vacuum device and pressure sensor (manometer) |
| 12 | Connection for pressure release valve (ball valve or plug valve without gasket) |
| 13 | Connection for a vacuum pump |
| 14 | Inner crucible |
| 15 | Starting mixture |
| 16.1 | Heater (electricity) |
| 16.2 | Heater (gas) |
| 17 | Heatable reduction furnace |
| 18 | Furnace/combustion chamber |
| 19 | Screw connection |
| 20 | Spacer assembly with support ring |
| 21 | Protection tube for temperature sensor |

The invention claimed is:

1. A method of making metal powder or alloy powder of an average particle size less than 10 μm, consisting of or containing at least one of the reactive metals zirconium, titanium or hafnium by the metallothermic reduction of the oxides or halogenides of the cited reactive metals with the aid of a reduction metal, wherein the metal powder or alloy powder is then phlegmatized by carrying out in addition to the reduction one or both of the following steps:

(a) adding passivating gases during the reduction of the oxides or halogenides, and/or after the reduction of the oxides or halogenides during cooling of the metal powder or alloy powder to phlegmatize the metal powder or alloy powder whereby as the passivating gases nitrogen in an amount of at least 1000 ppm and hydrogen in an amount of 500 to 2000 ppm are added into the metal powder or alloy powder, or (b) adding at least 2000 ppm (0.2% by weight) and at most 30,000 ppm (3% by weight) of a passivating solid substance prior to the reduction of the oxides or halogenides, the reduction as well as the phlegmatization being performed in a single gas-tight reaction container that can be evacuated.

2. The method according to claim 1, wherein nitrogen is added into the metal powder or alloy powder as passivating gas in an amount of 2000-3000 ppm.

3. The method according to claim 1, wherein nitrogen and hydrogen are added in the form of ammonia.

4. The method according to claim 1, wherein carbon is added in the gas phase in the form of methane, carbon dioxide or carbon monoxide.

5. The method according to claim 1, wherein the passivating gases are added into the reaction vessel during cooling of the fully reacted mass after a maximum temperature has been reached.

6. The method according to claim 1, wherein carbon, silicon, boron, nickel, chromium or aluminum is added as passivating solid substance, the passivating solid substance being added in the form of a fine oxide of the elements Ni, Cr, Al, Si and B with an average particle size less than 20 μm and being reduced together with the metal oxide or the passivating solid substance being added in the form of a fine powder of the elements Ni, Cr, Al, Si, B or C with an average particle size of less than 20 μm.

7. The method according to claim 1, wherein the ignitability of the phlegmatized metal powder or alloy powder is reduced further by washing out the sub-microscopically small particles with a particle size of less than 0.2 μm during leaching or washing.

8. A metal powder or alloy powder with an average particle size less than 10 μm measured according to the Blaine or the Fisher permeability method, consisting of or containing the reactive metals zirconium, titanium or hafnium, produced by the metallothermic reduction of the oxides or halogenides of these metals with the help of calcium or magnesium as reduction metal, processed and isolated by leaching in aqueous acids, wherein the metal powder or alloy powder contains (a) nitrogen in an amount of at least 1000 ppm and hydrogen in a minimum amount of 500 ppm as passivating gases or (b) a passivating solid substance selected from the group consisting of boron, carbon, nickel, and chromium with a proportional share of at least 2000 ppm (0.2% by weight) and at most 30,000 ppm (3% by weight), or both (a) and (b).

9. The metal powder or alloy powder according to claim 8, wherein nitrogen and hydrogen are contained in the metal powder or alloy powder in the form of ammonia.

10. The metal powder or alloy powder according to claim 8, wherein carbon is added into the metal powder or alloy powder via the gas phase in the form of methane, carbon dioxide or carbon monoxide or the powder contains carbon, boron, nickel, or chromium as passivating solid substance.

11. The metal powder or alloy powder according to claim 8, wherein the passivating solid substance was added in the form of a fine oxide of the elements Ni, Cr, Si and B with an average particle size less than 20 μm and was reduced together with the metal oxide or the passivating solid substance was added in the form of a fine powder of the elements Ni, Cr, B or C with an average particle size less than 20 μm.

12. A method of making metal powder or alloy powder of an average particle size less than 10 μm, consisting of or containing at least one of the reactive metals zirconium, titanium or hafnium by the metallothermic reduction of the oxides or halogenides of the cited reactive metals with the aid of a reduction metal, wherein the metal powder or alloy powder is then phlegmatized by carrying out in addition to the reduction both of the following steps:

(a) adding passivating gases comprising nitrogen and hydrogen during the reduction of the oxides or halogenides and/or after the reduction of the oxides or halogenides during cooling of the metal powder or alloy powder to phlegmatize the metal powder or alloy powder, whereby as the passivating gases nitrogen in an amount of at least 1000 ppm and hydrogen in an amount of 500 to 2000 ppm are added into the metal powder or alloy powder, and (b) adding at least 2000 ppm (0.2% by weight) and at most 30,000 ppm (3% by weight) of a passivating solid substance prior to the reduction of the oxides or halogenides, the reduction as well as the phlegmatization being performed in a single gas-tight reaction container that can be evacuated.

13. The method according to claim 12, wherein the nitrogen is added into the metal powder or alloy powder as passivating gas in an amount of 2000-3000 ppm.

14. The method according to claim 12, wherein nitrogen and hydrogen are added in the form of ammonia.

15. The method according to claim 12, wherein carbon is added via the gas phase in the form of methane, carbon dioxide or carbon monoxide.

16. The method according to claim 12, wherein the passivating gases are added into the reaction vessel during cooling of the fully reacted mass after a maximum temperature has been reached.

17. The method according to claim 12, wherein carbon, silicon, boron, nickel, chromium or aluminum is added as passivating solid substance, the passivating solid substance being added in the form of a fine oxide of the elements Ni, Cr, Al, Si and B with an average particle size less than 20 μm and being reduced together with the metal oxide or the passivating solid substance being added in the form of a fine powder of the elements Ni, Cr, Al, Si, B or C with an average particle size of less than 20 μm.

18. The method according to claim 12, wherein the ignitability of the phlegmatized metal powder or alloy powder is reduced further by washing out the sub-microscopically small particles with a particle size of less than 0.2 μm during leaching or washing.

19. A metal powder or alloy powder with an average particle size less than 10 μm measured according to the Blaine or the Fisher permeability method, consisting of or containing the reactive metals zirconium, titanium or hafnium, produced by the metallothermic reduction of the oxides or halogenides of these metals with the help of calcium or magnesium as reduction metal, processed and isolated by leaching in aqueous acids, wherein the metal powder or alloy powder contains (a) nitrogen in an amount of at least 1000 ppm and hydrogen in a minimum amount of 500 ppm as passivating gases and (b) a passivating solid substance with a proportional share of at least 2000 ppm (0.2% by weight) and at most 30,000 ppm (3% by weight).

20. The metal powder or alloy powder according to claim 19, wherein nitrogen and hydrogen are added to the metal powder or alloy powder in the form of ammonia.

21. The metal powder or alloy powder according to claim 19, wherein carbon is added into the metal powder or alloy powder via the gas phase in the form of methane, carbon dioxide or carbon monoxide or the powder contains carbon, silicon, boron nickel, chromium or aluminum as passivating solid substance.

22. The metal powder or alloy powder according to claim 19, wherein the passivating solid substance was added in the form of a fine oxide of the elements Ni, Cr, Si and B with an average particle size less than 20 μm and was reduced together with the metal oxide or the passivating solid substance was added in the form of a fine powder of the elements Ni, Cr, Al, Si, B or C with an average particle size less than 20 μm.

23. A method of making metal powder or alloy powder of an average particle size less than 10 μm, consisting of or containing at least one of the reactive metals zirconium, titanium or hafnium by the metallothermic reduction of the oxides or halogenides of the cited reactive metals with the aid of a reduction metal, wherein the metal powder or alloy powder is phlegmatized by carrying out in addition to the reduction the following step:

(a) adding passivating gases during the reduction of the oxides or halogenides, and/or after the reduction of the oxides or halogenides during cooling of the metal powder or alloy powder to phlegmatize the metal powder or alloy powder whereby as passivating gas nitrogen in an amount of at least 1000 ppm and hydrogen in an amount of 500 to 2000 ppm are added into the metal powder or alloy powder.

24. The method according to claim 23, wherein nitrogen is added into the metal powder or alloy powder as passivating gas in an amount of 2000-3000 ppm.

25. The method according to claim 23, wherein nitrogen and hydrogen are added in the form of ammonia.

26. The method according to claim 23, wherein carbon is added via the gas phase in the form of methane, carbon dioxide or carbon monoxide.

27. The method according to claim 23, wherein the passivating gases are added into the reaction vessel during cooling of the fully reacted mass after a maximum temperature has been reached.

28. A metal powder or alloy powder with an average particle size less than 10 μm measured according to the Blaine or the Fisher permeability method, consisting of or containing the reactive metals zirconium, titanium or hafnium, produced by the metallothermic reduction of the oxides or halogenides of these metals with the help of calcium or magnesium as reduction metal, processed and isolated by leaching in aqueous acids, wherein the metal powder or alloy powder contains (a) nitrogen in an amount of at least 1000 ppm and hydrogen in a minimum amount of 500 ppm as passivating gases.

29. The metal powder or alloy powder according to claim 28, wherein nitrogen and hydrogen are added to the metal powder or alloy powder in the form of ammonia.

30. A method of making metal powder or alloy powder of an average particle size less than 10 μm, consisting of or containing at least one of the reactive metals zirconium, titanium or hafnium by the metallothermic reduction of the oxides or halogenides of the cited reactive metals with the aid of a reduction metal, wherein the metal powder or alloy powder is then phlegmatized by carrying out in addition to the reduction both of the following steps:

(a) adding a passivating gas comprising nitrogen during the reduction of the oxides or halogenides and/or after the reduction of the oxides or halogenides during cooling of the metal powder or alloy powder to phlegmatize the metal powder or alloy powder, whereby as the passivating gas nitrogen in an amount of at least 1000 ppm is added into the metal powder or alloy powder, and (b) adding at least 2000 ppm (0.2% by weight) and at most 30,000 ppm (3% by weight) of a passivating solid substance prior to the reduction of the oxides or halogenides, the reduction as well as the phlegmatization being performed in a single gas-tight reaction container that can be evacuated.

31. A metal powder or alloy powder with an average particle size less than 10 μm measured according to the Blaine or the Fisher permeability method, consisting of or containing the reactive metals zirconium, titanium or hafnium, produced by the metallothermic reduction of the oxides or halogenides of these metals with the help of calcium or magnesium as reduction metal, processed and isolated by leaching in aqueous acids, wherein the metal powder or alloy powder contains (a) nitrogen in an amount of at least 1000 ppm as passivating gas and (b) a passivating solid substance with a proportional share of at least 2000 ppm (0.2% by weight) and at most 30,000 ppm (3% by weight).

* * * * *